US009043097B2

(12) United States Patent
Fehr

(10) Patent No.: US 9,043,097 B2
(45) Date of Patent: May 26, 2015

(54) SYSTEM AND METHOD FOR ESTIMATING MACHINE PITCH ANGLE

(71) Applicant: Caterpillar Inc., Peoria, IL (US)

(72) Inventor: Drew A. Fehr, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 220 days.

(21) Appl. No.: 13/653,986

(22) Filed: Oct. 17, 2012

(65) Prior Publication Data

US 2014/0107896 A1 Apr. 17, 2014

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |
| ***E02F 3/84*** | (2006.01) |
| ***E02F 9/20*** | (2006.01) |

(52) U.S. Cl.

CPC ..... *E02F 3/845* (2013.01); *E02F 3/844* (2013.01); *E02F 9/20* (2013.01); *E02F 9/2037* (2013.01); *E02F 3/841* (2013.01)

(58) Field of Classification Search

CPC ..... E02F 3/845; E02F 3/841; E02F 9/20; E02F 9/2037; E02F 3/844

USPC ..... 701/50

See application file for complete search history.

(56) References Cited

U.S. PATENT DOCUMENTS

| | | | | |
|---|---|---|---|---|
| 5,860,480 | A | 1/1999 | Jayaraman et al. | |
| 5,987,371 | A * | 11/1999 | Bailey et al. | 701/50 |
| 6,332,103 | B1 | 12/2001 | Steenson, Jr. et al. | |
| 7,677,323 | B2 | 3/2010 | Stratton et al. | |
| 7,979,179 | B2 | 7/2011 | Gansler | |
| 2010/0299031 | A1 * | 11/2010 | Zhdanov et al. | 701/50 |
| 2012/0130601 | A1 | 5/2012 | Banerjee et al. | |
| 2012/0239258 | A1 * | 9/2012 | Konno et al. | 701/50 |

* cited by examiner

*Primary Examiner* — Calvin Cheung
*Assistant Examiner* — Paula L Schneider
(74) *Attorney, Agent, or Firm* — Leydig, Voit & Mayer, Ltd.

(57) ABSTRACT

A system for the estimation of a pitch angle of machine includes a pitch rate sensor movable with the work implement and a position sensor mounted on the work implement. A controller is configured to determine a first estimate of the pitch angle of the machine based at least in part upon the pitch rate of the machine and determine a second estimate of the pitch angle of the machine based at least in part upon the position signals from the position sensor. The controller is configured to determine a combined estimate of the pitch angle of the machine based at least in part on the first estimate of the pitch angle and in part on the second estimate of the pitch angle.

20 Claims, 3 Drawing Sheets

SYSTEM AND METHOD FOR ESTIMATING MACHINE PITCH ANGLE

TECHNICAL FIELD

This disclosure relates generally to determining the pitch angle of a machine, and more particularly, to a system and method for estimating the pitch angle of a machine through the use of sensors mounted on or adjacent a work implement.

BACKGROUND

Machines such as a tractors, dozers and the like are often equipped with work implements for performing various tasks. For example, a dozer may be equipped with a ground engaging blade for performing tasks such as scraping the ground and moving material in a controlled fashion. An operator may move the blade in various directions relative to the ground. This is a task often performed during the construction of roads, buildings, and other structures.

In some instances, automated or semi-automated systems may assist an operator with the operation or control of the machine. In doing so, the machines are typically equipped with various sensors to monitor the operating parameters of the machine. The systems of the machine may use data from the sensors to assist in controlling some of the operations of the machine. The number of sensors and the operating characteristics of the sensors on the machine may create limitations on the types of automated or semi-automated systems that are available to an operator.

Knowledge of the pitch angle of a machine may be useful for one or more systems of the machine. However, some machines do not include sensors to directly determine the pitch angle of the machine.

U.S. Pat. No. 5,860,480 discloses a system for determining the pitch angle of a machine. In such case, the machine includes a pitch angle sensor but such sensor may not perform particularly well in dynamic applications. Accordingly, the system uses additional sensed data to assist in the estimation of the pitch angle.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for the estimation of a pitch angle of machine having a work implement movable relative to the machine includes a pitch rate sensor and a position sensor. The pitch rate sensor is mounted on the machine, is movable with the work implement, and is configured to provide a pitch rate signal indicative of a pitch rate of the work implement. The position sensor is mounted on the machine, is movable with the work implement, and is configured to sense a position of the work implement and to provide a position signal indicative of the position of the work implement. A controller is configured to receive the pitch rate signal from the pitch rate sensor, to determine a pitch rate of the machine based at least in part upon the pitch rate signal, and to determine a first estimate of the pitch angle of the machine based at least in part upon the pitch rate of the machine. The controller is further configured to receive the position signal from the position sensor, to determine a second estimate of the pitch angle of the machine based at least in part upon the position signal, and to determine a combined estimate of the pitch angle of the machine based at least in part on the first estimate of the pitch angle of the machine and at least in part on the second estimate of the pitch angle of the machine.

In another aspect, a controller implemented method for estimating a pitch angle of a machine includes providing a work implement movable relative to the machine, receiving a pitch rate signal from a pitch rate sensor indicative of a pitch rate of the work implement, determining a pitch rate of the machine based at least in part upon the pitch rate signal, and determining a first estimate of the pitch angle of the machine based at least in part upon the pitch rate of the machine. The method further includes receiving a position signal from a position sensor, determining a second estimate of the pitch angle of the machine based at least in part upon the position signal, and determining a combined estimate of the pitch angle of the machine based at least in part on the first estimate of the pitch angle of the machine and at least in part on the second estimate of the pitch angle of the machine.

In still another aspect, a machine includes a prime mover, a work implement configured for movement relative to the machine, and a system for moving the work implement relative to the machine based upon an implement velocity command. A pitch rate sensor is mounted on the machine, is movable with the work implement, and is configured to provide a pitch rate signal indicative of a pitch rate of the work implement. A position sensor is mounted on the machine, is movable with the work implement, and is configured to sense a position of the work implement and to provide a position signal indicative of the position of the work implement. A controller is configured to receive the pitch rate signal from the pitch rate sensor, to determine a pitch rate of the machine based at least in part upon the pitch rate signal, and to determine a first estimate of the pitch angle of the machine based at least in part upon the pitch rate of the machine. The controller is further configured to receive the position signal from the position sensor, to determine a second estimate of the pitch angle of the machine based at least in part upon the position signal, and to determine a combined estimate of the pitch angle of the machine based at least in part on the first estimate of the pitch angle of the machine and at least in part on the second estimate of the pitch angle of the machine.

DETAILED DESCRIPTION

Figure 1:
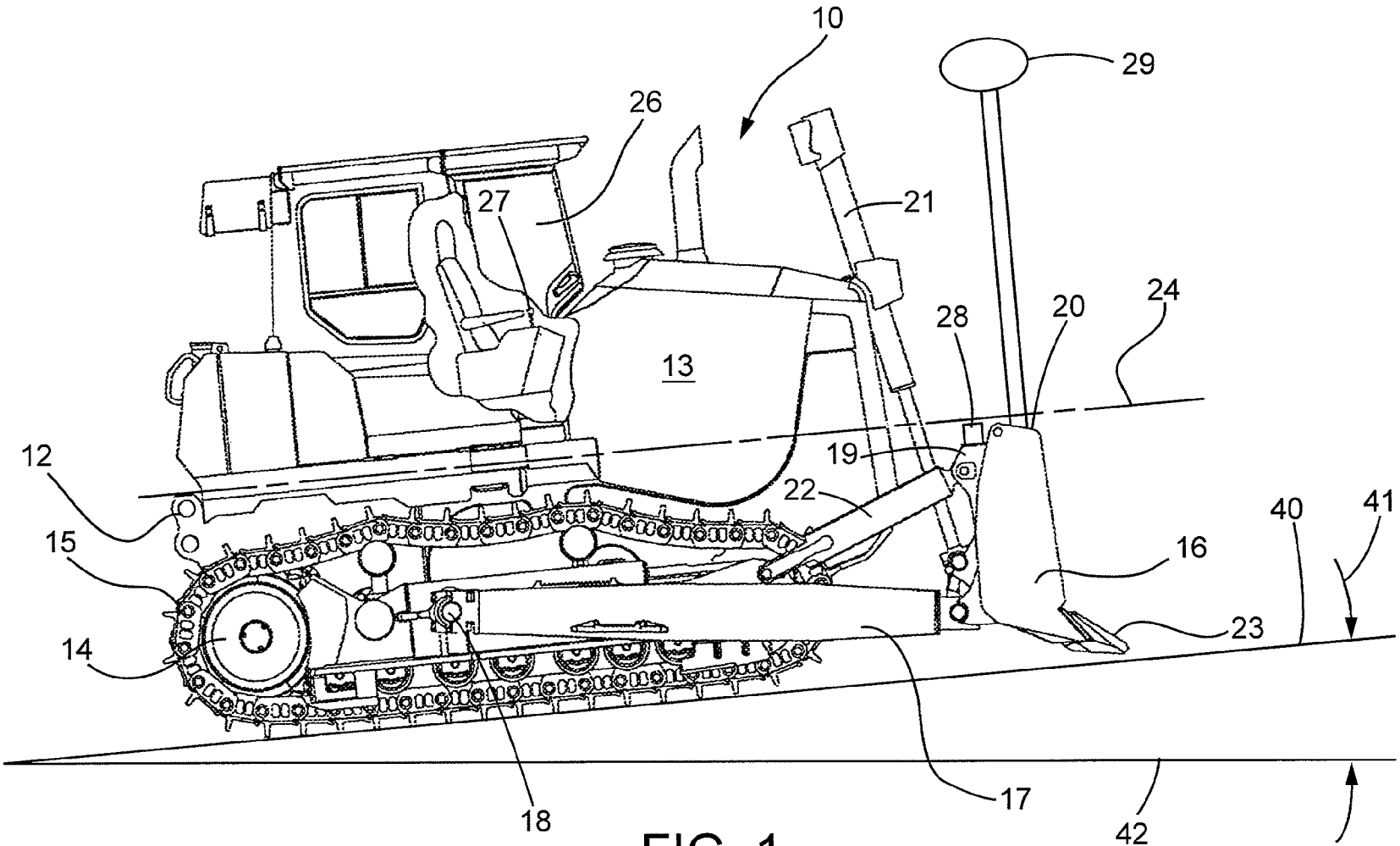
FIG. 1 shows a diagrammatic illustration of a machine in accordance with the disclosure.

FIG. 1 shows a diagrammatic illustration of a machine 10 such as a dozer in accordance with an embodiment of the disclosure. The machine 10 includes a frame 12 and a prime mover such as an engine 13. A ground-engaging drive mechanism such as a track 15 is driven by a drive wheel 14 on each side of machine 10 to propel the machine. Although machine 10 is shown in a "track-type" configuration, other configurations, such as a wheeled configuration, may be used.

Machine 10 may include a work implement 16 such as a blade pivotally connected to frame 12 by arms 17 at arm joint 18 on each side of machine 10. The systems and methods disclosed herein may also be used on machines other than a machine having a ground-engaging blade. First hydraulic cylinder 21 coupled to frame 12 supports the work implement 16 in the vertical direction, and allows the work implement 16 to move up or down vertically from the point of view of FIG. 1. Second hydraulic cylinders 22 on each side of machine 10 allow the pitch angle of blade tip 23 to change relative to a centerline 24 of the machine.

Machine 10 may include a cab 26 from which an operator may provide input to control the machine. Cab 26 may include one or more input devices 27 from which the operator issues commands. The operator may issue commands to control the propulsion and steering of the machine 10 as well as operate various implements associated with the machine. In some situations, it may be desirable to utilize automated controls to assist or override commands issued by the operator. In one embodiment, an operator may command the work implement 16 to move vertically at a predetermined rate by issuing an implement velocity command.

Machine 10 may be equipped with a plurality of sensors that provide data indicative (directly or indirectly) of various operating parameters of the machine. The term "sensor" is meant to be used in its broadest sense to include one or more sensors and related components that may be associated with the machine 10 and that may cooperate to sense various functions, operations, and operating characteristics of the machine.

A pitch rate sensor 28 (e.g., a gyroscope) may be provided or mounted on the work implement 16 or on implement frame member 19 to which the work implement is mounted. Accordingly, the pitch rate sensor 28 is movable with the work implement 16. The pitch rate sensor 28 may be used to provide a pitch rate signal indicative of a measured pitch rate of the work implement 16. The pitch rate sensor 28 may be a "stand-alone" sensor or part of a multi-function sensor such as an inertial measurement unit that also measures the acceleration of the machine 10 along various axes. As the work implement 16 moves, the measured pitch rate will be indicative of the rate of change of the pitch angle of the work implement 16. Movement of the work implement 16 may be caused by movement of the machine 10 relative to the work surface 40, by movement of the work implement 16 relative to the frame 12, or a combination of the two. In one example, the pitch rate sensor 28 may provide a pitch rate signal to the controller 31 every 10 milliseconds.

A position sensor 29 may be provided or mounted on the work implement 16 or on a frame member 19 to which the work implement is mounted. Accordingly, the position sensor 29 is movable with the work implement 16. The position sensor 29 may include one or more sensors that interact with a positioning system such as a global positioning system "GPS" to operate as a GPS sensor. In the embodiment depicted in FIG. 1, the machine 10 includes a pair of spaced apart position sensors 29 positioned above opposite lateral upper ends 20 of the work implement 16. The position sensor 29 may be used to provide a position signal indicative of a position of the work implement 16. In one example, the position sensor 29 may provide a position signal to the controller 31 every 100 milliseconds.

Figure 2:
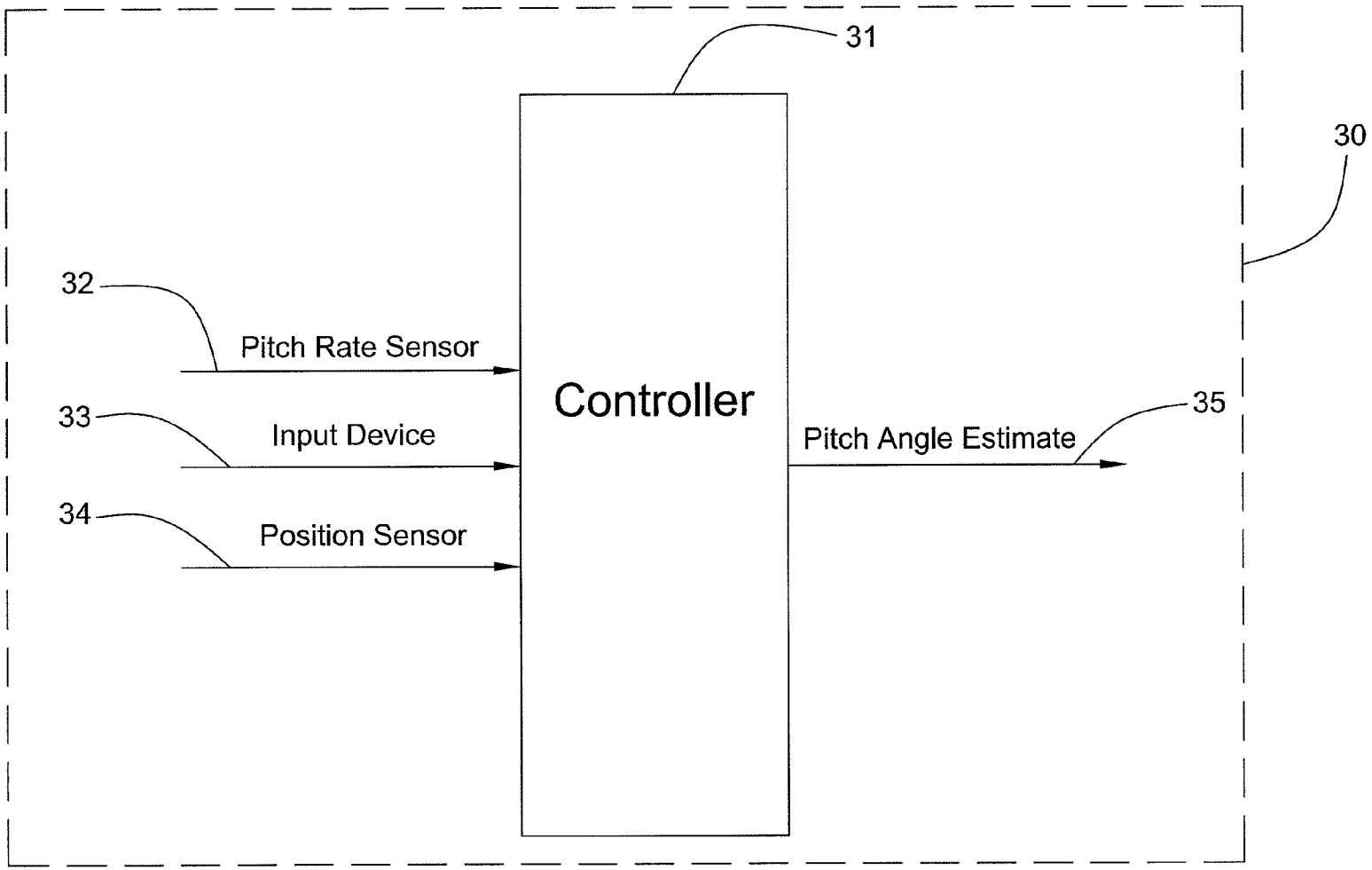
FIG. 2 is a block diagram of a pitch angle estimation system in accordance with the disclosure.

A control system 30, as shown in FIG. 2, may be provided to control the operation of the machine 10 in an efficient manner. The control system may include an electronic control module or controller 31. The controller 31 may receive operator input command signals and control the operation of the hydraulic systems that operate the drive wheels 14 and thus tracks 15. The control system may use the input devices 27 to control the machine 10 and one or more sensors, including pitch rate sensor 28 and position sensor 29 to provide data and other input signals representative of various operating parameters of the machine 10.

The controller 31 may be an electronic controller that operates in a logical fashion to perform operations, execute control algorithms, store and retrieve data and other desired operations. The controller 31 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller such as power supply circuitry, signal conditioning circuitry, driver circuitry, and other types of circuitry.

The controller 31 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 31 may be implemented in hardware and/or software without regard to the functionality. The controller 31 may rely on one or more data maps relating to the operating conditions of the machine 10 that may be stored in the memory of controller. Each of these maps may include a collection of data in the form of tables, graphs, and/or equations.

The control system 30, including the pitch rate sensor 28 and the position sensor 29, may be configured to operate as a pitch angle estimation system for determining the pitch angle 41 of the machine 10 (i.e., the angle between the work surface 40 and a horizontal reference 42) based upon a plurality of inputs. Referring to FIG. 2, the controller 31 may receive information from various sensors of the machine 10 and process this information. In doing so, the controller 31 may be configured to receive, at node 32, as a first input a pitch rate signal from the pitch rate sensor 28 indicative of a pitch rate of the work implement 16. The controller 31 may be further configured to receive, at node 33, as a second input an implement velocity signal from input device 27 indicative of an implement velocity command from an operator. At node 34, the controller may receive as a third input a position signal indicative of a position of the work implement 16. The position signal may be provided by the position sensor 29.

As described in more detail below, the controller 31 may determine an estimate of the pitch angle 41 of the machine 10. The controller 31 may generate, at node 35, a signal indicative of an estimate of the pitch angle of the machine 10. This signal may be provided to other aspects of the control system 30, a remote system, or an operator as desired. The controller 31 may use the first input and the second input to determine a first estimate of the pitch angle ($\theta_{1st}$) of the machine 10. The controller 31 may further use the third input to determine a second estimate of the pitch angle ($\theta_{2nd}$) of the machine 10. The controller 31 may use the first estimate of the pitch angle ($\theta_{1st}$) of the machine 10 and the second estimate of the pitch angle ($\theta_{2nd}$) of the machine to determine a combined estimate of the pitch angle ($\theta_{est}$) of the machine that is generally more accurate than the first estimate alone and generally has a faster response time than the second estimate.

To determine the first estimate of the pitch angle ($\theta_{1st}$) of the machine 10, pitch rate signals are provided by the pitch rate sensor 28 associated with the work implement 16 to the controller 31. The pitch rate signals from the pitch rate sensor 28 will reflect the change in the pitch angle (i.e., the pitch rate) of the work implement 16 when either the pitch angle of the work implement 16 is changed, when the pitch angle of the machine 10 is changed, or when both the pitch angle of the machine 10 and the work implement 16 are changed simultaneously in a non-canceling manner. Thus, the pitch rate ($P_S$) as measured by the pitch rate sensor 28 may be described as the sum of the pitch rate of the machine ($P_M$) and the pitch rate of the work implement ($P_B$):

$$P_S=P_M+P_B \tag{1}$$

This equation may be re-arranged to solve for the pitch rate of the machine 10 ($P_M$):

$$P_M=P_S-P_B \tag{2}$$

The pitch rate of the work implement ($P_B$) may be estimated from the implement velocity signal received by controller 31 based upon the implement velocity command. Assuming that the work implement 16 actually moves at the rate commanded by the implement velocity command, the pitch rate of the work implement ($P_B$) may be expressed as:

$$P_B=V_B/R_B \tag{3}$$

where $V_B$ is the velocity of the work implement 16 as commanded by the operator and $R_B$ is the radius of the curve about which the work implement rotates. Referring back to FIG. 1, it may be seen that the radius ($R_B$) may be generally equal to the length of arm 17. In another example, the radius ($R_B$) may be set as the distance between the arm joint 18 and the pitch sensor 29. Substituting equation (3) into equation (2) results in the pitch rate of the machine ($P_M$) being expressed as a function of the measured pitch rate ($P_S$), the velocity of the work implement 16 ($V_B$), and the radius ($R_B$) as follows:

$$P_M=P_S-V_B/R_B \tag{4}$$

A first estimate of the pitch angle ($\theta_{1st}$) of the machine 10 may be determined by integrating the machine pitch rate ($P_M$) over time (t):

$$\theta_{1st}=\int_0^t P_M \tag{5}$$

However, integrating the machine pitch rate ($P_M$) may introduce a degree of pitch integration error. To correct for this error, a filter, such as a Kalman filter, which is well known in the art, may be used to provide a pitch rate bias estimate ($\text{bias}_{pitch\ rate}$) that may be used to adjust the machine pitch rate ($P_M$) prior to integration:

$$\theta_{1st}=\int_0^t (P_M-\text{bias}_{pitch\ rate}) \tag{6}$$

In one configuration, the filter may operate by using a previously determined first estimate of the pitch angle ($\theta^-_{1st}$) of the machine. The previously determined first estimate of the pitch angle ($\theta^-_{1st}$) may be compared to the most recently determined second estimate of the pitch angle ($\theta^-_{2nd}$) to determine a residual. The residual may then be used to determine the pitch rate bias estimate ($\text{bias}_{pitch\ rate}$) which may be subtracted from the machine pitch rate ($P_M$) as shown in equation (6). The pitch rate bias estimate ($\text{bias}_{pitch\ rate}$) may be updated each time a second estimate of the pitch angle ($\theta_{2nd}$) is determined.

To determine the second estimate of the pitch angle ($\theta_{2nd}$) of machine 10, the controller 31 may receive a position signal from the position sensor 29 and determines the current position of machine 10. Based upon the current position of the machine 10 and historical data stored or logged within the controller 31, the controller may determine a second estimate of the pitch angle ($\theta_{2nd}$) of the machine as follows:

$$\theta_{2nd}=\tan^{-1}(\Delta\text{Elevation}/\Delta\text{Distance}) \tag{7}$$

where the ΔElevation is the change in elevation or vertical movement of the machine 10 as indicated by the historical data from the position sensor 29, and ΔDistance is the horizontal movement of the machine 10 as indicated by the historical data from the position sensor. In other words, based on the change in the sensed position of the machine 10 over time, the controller 31 may determine the elevation change experienced by the machine over a measured distance and calculate the slope of the terrain over which the machine is traveling (i.e., the second estimate of the pitch angle ($\theta_{2nd}$)).

The controller 31 may utilize a combination of the first estimate of the pitch angle ($\theta_{1st}$) of the machine 10 and the second estimate of the pitch angle ($\theta_{2nd}$) of the machine to determine a third or combined estimate of the pitch angle ($\theta_{est}$) of the machine. The third estimate may be generally more accurate than the first estimate alone and generally has a faster response time than the second estimate.

When determining the combined estimate of the pitch angle ($\theta_{est}$), the controller 31 may use different methodologies depending on the operating parameters of or operating conditions encountered by the machine 10. In some embodiments, the controller 31 may be configured to primarily rely upon the first estimate of the pitch angle ($\theta_{1st}$) and rely secondarily upon the second estimate of the pitch angle ($\theta_{2nd}$) to determine the combined estimate. The controller 31 may be configured to apply different weighting methodologies based upon the speed at which the machine 10 is moving. For example, if the machine 10 is moving very slowly, the horizontal movement of the machine 10 (ΔDistance) will be relatively small and thus the second estimate of the pitch angle ($\theta_{2nd}$) may not be as accurate as desired. As the velocity of the machine 10 increases, the horizontal movement of the machine 10 (ΔDistance) increases and the second estimate of the pitch angle ($\theta_{2nd}$) may become more accurate.

In one embodiment, if the machine 10 is moving faster than a predetermined speed (e.g., approximately 1 meter/second), the controller 31 may apply a first weight to the first estimate of the pitch angle ($\theta_{1st}$) (e.g., 80%) and a second weight to the second estimate of the pitch angle ($\theta_{2nd}$) (e.g., 20%). If the machine is moving slower than a predetermined speed (e.g., approximately 0.15 meters/second), the controller 31 may reduce the weight of the second estimate of the pitch angle ($\theta_{2nd}$) or hold or maintain the second estimate at a constant value equal to a previously determined second estimate of the pitch angle rather than using the most recently determined second estimate of the pitch angle ($\theta_{2nd}$). As a result, inaccuracies due to the slow velocity will be minimized. As the velocity of the machine 10 decreases from the first predetermined speed (e.g., 1.0 meter/second) to the second predetermined speed (e.g., 0.15 meters/second), the controller 31 may utilize a scale of weighting that decreases (e.g., linearly) with the decrease in speed. Other thresholds and ranges as well as non-linear weighting methodologies are contemplated.

In another example, the controller 31 may be configured to change the weights applied to the first estimate of the pitch angle ($\theta_{1st}$) and the second estimate of the pitch angle ($\theta_{2nd}$) based upon the load on the work implement 16. High or non-uniform loads may result in less accurate estimates of the first estimate of the pitch angle ($\theta_{1st}$) due to the integration of equations (5) and (6).

In one example, the non-uniform loads may be applied to the work implement 16 when the machine 10 is traveling over a relatively bumpy work surface 40. Accordingly, the controller 31 may apply different weighting methodologies depending on the profile of the terrain over which the machine 10 is traveling. For example, it may be desirable to apply a different weighting methodology when the machine 10 is traveling over a relatively smooth work surface 40 as compared to a relatively bumpy work surface. More specifically, when traveling over a relatively smooth work surface 40, the controller 31 may apply a first weighting factor to the first estimate of the pitch angle ($\theta_{1st}$) and a second weighting factor to the second estimate of the pitch angle ($\theta_{2nd}$). When traveling over a relatively bumpy work surface 40, the controller may reduce the first weighting factor and increase the second weighting factor.

In still another example, the controller 31 may apply different weighting methodologies at different times depending on how long the machine 10 has been operating in a particular manner. For example, when beginning operation of the machine 10 or a particular task, the controller 31 may not have a significant amount of historical data and thus may be configured to place a greater weight on the first estimate of the pitch angle ($\theta_{1st}$). Similarly, if the controller 31 has been unable to calculate a new second estimate of the pitch angle ($\theta_{2nd}$) for a predetermined number of cycles, it may be desirable to place a greater weight on a newly generated second estimate of the pitch angle $\theta_{2nd}$ when a new second estimate of the pitch angle $\theta_{2nd}$ is ultimately calculated by the controller. A wide variety of weighting factors and methodologies are possible. Those set forth above are only a few examples that may be possible.

Figure 3:
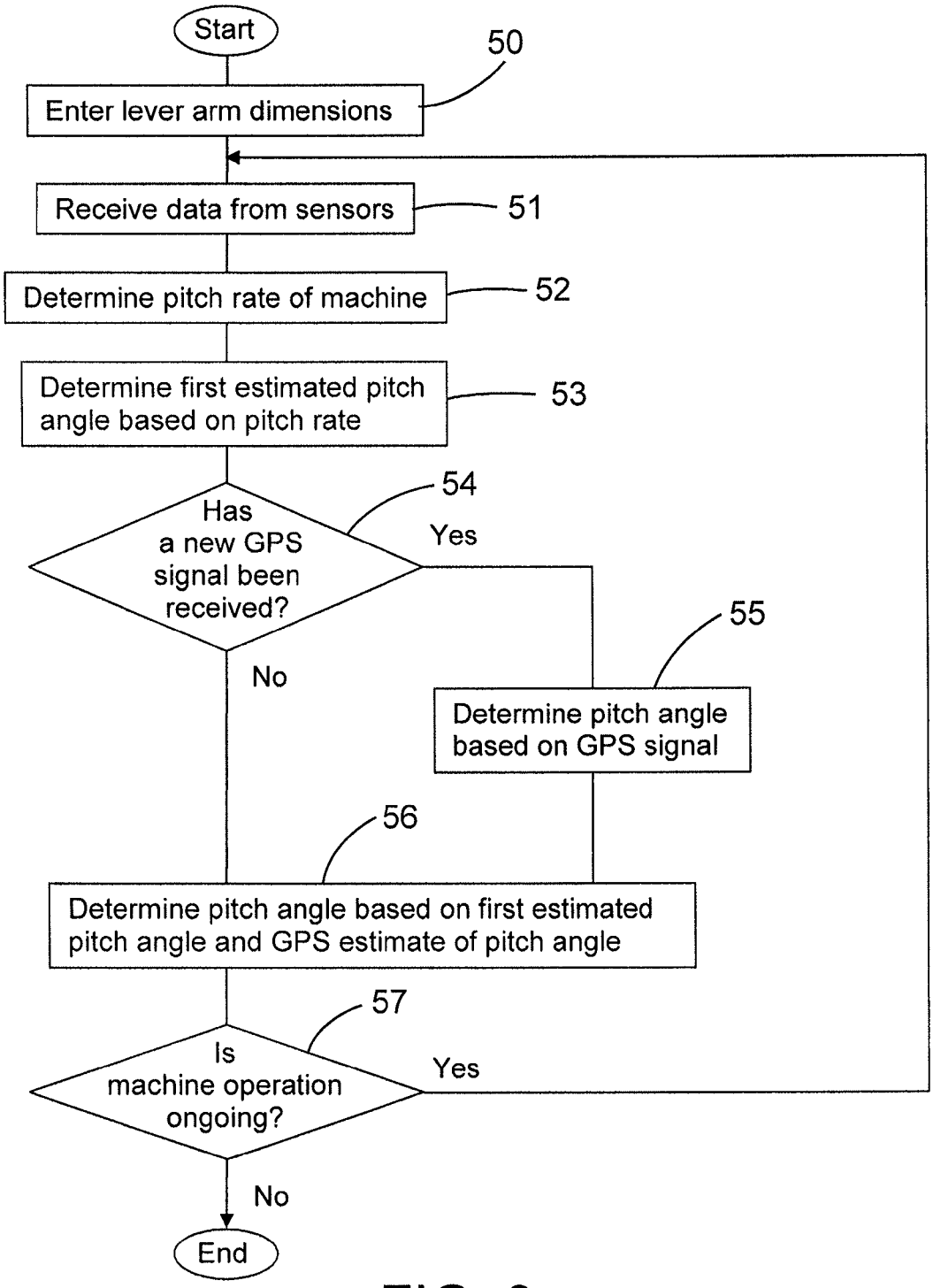
FIG. 3 is a flowchart illustrating a pitch angle estimation process in accordance with the disclosure.

FIG. 3 depicts a flowchart of a process for determining an estimate of the pitch angle of the machine 10. At stage 50, the length of the radius ($R_B$) about which the work implement 16 rotates may be entered into the controller 31. In one embodiment, the length of the radius ($R_B$) may be the distance from the arm joint 18 at which the arm 17 is mounted to frame 12 to the pitch rate sensor 28. In an alternate embodiment the length of the radius ($R_B$) may be approximated by the length of the arm 17.

At stage 51, the controller 31 may receive data from the various sensors that may be used to estimate the pitch angle of the machine 10. More specifically, the controller 31 may receive pitch rate signals from the pitch rate sensor 28 and position signals from the position sensor 29. In one embodiment, the controller 31 may receive pitch rate signals every 100 milliseconds and position signals every 10 milliseconds. Accordingly, the controller 31 may receive ten pitch rate signals for every one position signal received.

The controller 31 may use equation (4) together with the pitch rate signal and the implement velocity command to determine at stage 52 the pitch rate of the machine ($P_M$). At stage 53, the controller may use equation (5) to determine the first estimate of the pitch angle ($\theta_{1st}$). In an alternate embodiment, a pitch rate bias estimate ($bias_{pitch\ rate}$) may be included with the calculation of the first estimate of the pitch angle ($\theta_{1st}$) as set forth in equation (6).

At decision stage 54, the controller 31 may determine whether a position signal has been received from the position sensor 29. If a new position signal has been received, the controller 31 may use the new position signal together with historical data, such as previously received position signals, to determine at stage 55 a second estimate of the pitch angle ($\theta_{2nd}$) based upon equation (7). In one example, the controller 31 may use approximately four data points to determine the second estimate of the pitch angle ($\theta_{2nd}$). In other words, the controller 31 may use a new position signal received from the position sensor 29 together with the three most recently received position signals to determine the second estimate of the pitch angle ($\theta_{2nd}$). The controller 31 may use the most recently received first estimate of the pitch angle ($\theta_{1st}$) together with the newly determined second estimate of the pitch angle ($\theta_{2nd}$) to determine the combined estimate of the pitch angle ($\theta_{est}$) at stage 56.

If a new position signal has not been received at decision stage 54, the controller 31 may use at stage 56 the most recently determined first estimate of the pitch angle ($\theta_{1st}$) together with the previously determined second estimate of the pitch angle ($\theta_{2nd}$) to determine the combined estimate of the pitch angle ($\theta_{est}$). When determining the combined estimate of the pitch angle ($\theta_{est}$), the weighting of the first estimate of the pitch angle ($\theta_{1st}$) and the second estimate of the pitch angle ($\theta_{2nd}$) may be adjusted based upon various factors such as the velocity of the machine 10, the terrain over which the machine is moving, and the time since the receipt of the previous position signal.

After the combined estimate of the pitch angle ($\theta_{est}$) is determined at stage 56, the controller 31 may determine at decision stage 57 whether the machine 10 is continuing to be operated. If operation of the machine 10 is ongoing, the operation of the system for determining an estimated pitch angle may continue at stage 51 with the controller 31 receiving data from the sensors. If the operation of the machine 10 is not ongoing, the operation of the system may be terminated. Since the control system 30 may be configured so that the controller 31 receives ten pitch rate signals for each position signal received, the controller 31 may pass through stages 50-54 and 56-57 ten times for each time the controller passes through stage 55.

INDUSTRIAL APPLICABILITY

The industrial applicability of the system described herein will be readily appreciated from the foregoing discussion. The foregoing discussion is applicable to machines 10 that utilize a work implement 16 and that include sensors on or movable with the work implement. The sensors may be used determine certain operating parameters of the work implement 16 that are then used by a control system 30 to control certain operations of the machine 10. In one aspect, it may be desirable to determine the pitch angle 41 of a machine 10 even though the machine 10 does not have sensors for directly measuring the pitch angle.

The machine 10 may include a pitch rate sensor 28 and a position sensor 29 either on or movable with the work implement 16. A controller 31 of control system 30 may be configured to generate a first estimate of the pitch angle ($\theta_{1st}$) of the machine 10 based upon pitch rate signals received from the pitch rate sensor 28. The controller 31 may be configured to generate a second estimate of the pitch angle ($\theta_{2nd}$) of the machine 10 based upon position signals received from the position sensor 29. The controller 31 may further be configured to utilized both the first estimate of the pitch angle ($\theta_{1st}$) and the second estimate of the pitch angle ($\theta_{2nd}$) to determine a third estimate of the pitch angle ($\theta_{est}$) that is generally more accurate than the first estimate alone and generally has a faster response time than the second estimate. When determining the combined third estimate of the pitch angle ($\theta_{est}$), the weighting of the first estimate of the pitch angle ($\theta_{1st}$) and the second estimate of the pitch angle ($\theta_{2nd}$) may be adjusted based upon various factors including the velocity of the machine 10, the terrain over which the machine is moving, and the time since the receipt of the previous position signal. Other factors that may influence the weighting are contemplated.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for estimation of a pitch angle of a machine, the machine including a work implement configured for movement relative to the machine, the system comprising:

a work implement pitch rate sensor mounted on the machine and movable with the work implement, the work implement pitch rate sensor being configured to provide a work implement pitch rate signal indicative of a pitch rate of the work implement;

a work implement position sensor mounted on the machine and movable with the work implement, the work implement position sensor being configured to sense a position of the work implement and provide a work implement position signal indicative of the position of the work implement; and a controller configured to:

receive the work implement pitch rate signal from the work implement pitch rate sensor;

determine a pitch rate of the machine based at least in part upon the work implement pitch rate signal;

determine a first estimate of the pitch angle of the machine based at least in part upon the pitch rate of the machine;

receive the work implement position signal from the work implement position sensor;

determine a second estimate of the pitch angle of the machine based at least in part upon the work implement position signal; and determine a combined estimate of the pitch angle of the machine based at least in part on the first estimate of the pitch angle of the machine and at least in part on the second estimate of the pitch angle of the machine.

2. The system of claim 1, further including a system for moving the work implement relative to the machine based upon an implement velocity command and the controller is further configured to determine the first estimate of the pitch angle of the machine based at least in part upon the implement velocity command.

3. The system of claim 1, wherein the controller is further configured to determine the second estimate of the pitch angle of the machine based at least in part upon horizontal movement of the machine.

4. The system of claim 1, wherein the controller is further configured to determine the combined estimate of the pitch angle of the machine based at least in part upon a difference between the first estimate of the pitch angle of the machine and the second estimate of the pitch angle of the machine.

5. The system of claim 1, wherein the controller is further configured to determine the second estimate of the pitch angle of the machine based at least in part upon historical data from the work implement position sensor.

6. The system of claim 5, wherein the controller utilizes data from approximately four data points from the work implement position sensor to determine the second estimate of the pitch angle of the machine.

7. The system of claim 1, wherein the controller is further configured to apply different weights to the first estimate of the pitch angle of the machine and the second estimate of the pitch angle of the machine to determine the combined estimate of the pitch angle of the machine.

8. The system of claim 7, wherein the different weights may be determined based upon a velocity at which the machine is traveling.

9. The system of claim 7, wherein the different weights may be determined based upon a load on the work implement.

10. The system of claim 1, wherein the controller is configured to generate the combined estimate of the pitch angle of the machine utilizing a previously determined second estimate of the machine pitch angle of the machine when the machine is moving slower than a predetermined speed.

11. The system of claim 1, wherein the work implement position sensor includes a GPS sensor.

12. The system of claim 1, wherein the work implement pitch rate sensor includes an inertial measurement unit.

13. A controller implemented method for estimating a pitch angle of a machine, comprising:

providing a work implement movable relative to the machine;

receiving a work implement pitch rate signal from a work implement pitch rate sensor movable with the work implement and indicative of a pitch rate of the work implement;

determining a pitch rate of the machine based at least in part upon the work implement pitch rate signal;

determining a first estimate of the pitch angle of the machine based at least in part upon the pitch rate of the machine;

receiving a work implement position signal from a work implement position sensor movable with the work implement;

determining a second estimate of the pitch angle of the machine based at least in part upon the work implement position signal; and determining a combined estimate of the pitch angle of the machine based at least in part on the first estimate of the pitch angle of the machine and at least in part on the second estimate of the pitch angle of the machine.

14. The method of claim 13, including further determining the first estimate of the pitch angle of the machine based at least in part upon an implement velocity command.

15. The method of claim 13, further including determining the second estimate of the pitch angle of the machine based at least in part upon horizontal movement of the machine.

16. The method of claim 13, further including determining the combined estimate of the pitch angle based at least in part upon a difference between the first estimate of the pitch angle of the machine and the second estimate of the pitch angle of the machine.

17. The method of claim 13, further including determining the second estimate of the pitch angle of the machine based at least in part upon historical data from the work implement position sensor.

18. The method of claim 13, further including applying different weights to the first estimate of the pitch angle of the machine and the second estimate of the pitch angle of the machine to determine the combined estimate of the pitch angle of the machine.

19. The method of claim 18, including determining the different weights based upon a velocity at which the machine is traveling.

20. A machine comprising:

a prime mover;

a work implement configured for movement relative to the machine;

a system for moving the work implement relative to the machine based upon an implement velocity command;

a work implement pitch rate sensor mounted on the machine and movable with the work implement, the work implement pitch rate sensor being configured to provide a work implement pitch rate signal indicative of a pitch rate of the work implement;

a work implement position sensor mounted on the machine and movable with the work implement, the work implement position sensor being configured to sense a position of the work implement and provide a work implement position signal indicative of the position of the work implement; and a controller configured to:

receive the work implement pitch rate signal from the work implement pitch rate sensor;

determine a pitch rate of the machine based at least in part upon the work implement pitch rate signal;

determine a first estimate of a pitch angle of the machine based at least in part upon the pitch rate of the machine;

receive the work implement position signal from the work implement position sensor;

determine a second estimate of the pitch angle of the machine based at least in part upon the work implement position signal; and determine a combined estimate of the pitch angle of the machine based at least in part on the first estimate of the pitch angle of the machine and at least in part on the second estimate of the pitch angle of the machine.

* * * * *